United States Patent [19]

Miyamoto et al.

[11] 4,363,019

[45] Dec. 7, 1982

[54] IGNITION CABLES

[75] Inventors: Yoshimi Miyamoto, Aichi; Keiichi Kojima; Yasuo Toriumi, both of Osaka, all of Japan

[73] Assignees: Sumitomo Electric Industries, Osaka; Nippondenso Co., Ltd., Aichi, both of Japan

[21] Appl. No.: 230,928

[22] Filed: Feb. 2, 1981

[30] Foreign Application Priority Data

Jan. 31, 1980 [JP] Japan ..... 55/11441

[51] Int. Cl.[3] ..... H01C 3/06

[52] U.S. Cl. ..... 338/214; 338/66

[58] Field of Search ..... 338/66, 214, 239, 26; 174/120 SC, 113 R, 102 SC, 105 SC, 106 SC, 104; 252/510, 511; 156/50, 51, 52; 427/118; 428/373, 36

[56] References Cited

U.S. PATENT DOCUMENTS

| | | | |
|---|---|---|---|
| 2,563,952 | 8/1951 | Nichol | 338/66 X |
| 2,707,205 | 4/1955 | Abbott et al. | 174/120 SC |
| 3,683,309 | 8/1972 | Hirosie | 338/214 |
| 3,772,454 | 11/1973 | Donecker et al. | 174/113 R |

*Primary Examiner*—C. L. Albritton

*Attorney, Agent, or Firm*—Sughrue, Mion, Zinn, Macpeak & Seas

[57] ABSTRACT

A high voltage ignition cable having low capacitance comprising a resistive-conductor core, an insulator layer, and a jacket, wherein the resistive-conductor core comprises a tension member prepared by intertwining a plurality of polyaramide fiber bundles around a central polyaramide fiber bundle, is described.

4 Claims, 3 Drawing Figures

IGNITION CABLES

BACKGROUND OF THE INVENTION

This invention relates to improvements in a high voltage-ignition cable (hereinafter referred to as an "ignition cable") which is used to suppress radio interference generated by electrical ignition in an internal combustion engine, e.g., in a car, etc.

When conductive substances such as salts (e.g., for the prevention of freezing of roads in a cold district), sludge, etc., attach onto the external surface of a jacket of the ignition cable and the impedance thereof relative to the ground potential is lowered, the charging current flows out thereto according to the electrostatic capacity between a resistive-conductor core (hereinafter referred to as a "core", for simplicity) and the external surface of the jacket.

Therefore, as the electrostatic capacity increases, a reduction in the ignition voltage increases, resulting in poor ignition. In order to eliminate such poor ignition, it is necessary to use an ignition cable having as low electrostatic capacity as 80 pF/m or less.

One way of lowering the electrostatic capacity is to increase the outer diameter of the ignition cable. However, increasing the outer diameter is not desirable, since the outer diameter of the ignition cable is usually about 7 or 8 mm, and cannot be exchanged with conventional ones, and requires additional space.

In order to lower the electrostatic capacity while holding the outer diameter at a constant level, it is necessary to reduce the outer diameter of the core, and in order to lower the electrostatic capacity to the above-described level of 80 pF/m or less, it is necessary to reduce the outer diameter of the core to 1.2 mm or less.

By merely reducing the outer diameter of the core, however, the core will be cut off during the course of extrusion or vulcanization of the insulator, jacket, or the like, and thus it is not possible to produce, on a commercial scale, ignition cables which are sufficiently stabilized in voltage-withstanding ability, as in the case where glass fiber bundles are used as a tension member. The use of aromatic polyamide (hereinafter referred to as "polyaramide") fiber bundles instead of the glass fiber bundle avoids the above-described defects but does not give rise to a sufficient high voltage-withstanding ability as described hereinafter. Furthermore, stabilizing the high voltage-withstanding ability, problems such as difficulty in working of the termination of the cable, etc., arise.

SUMMARY OF THE INVENTION

The first object of this invention is to provide an ignition cable having a low electrostatic capacity as described hereinbefore, and at the same time to overcome the problems arising in reducing the outer diameter of the core in using a glass fiber bundle, and in using a polyaramide fiber bundle.

The second object of this invention is to provide an ignition cable having a stabilized resistance not by merely bundling or twining the polyaramide fiber bundles as used as a core member, but by intertwining a plurality of polyaramide fiber bundles around a central polyaramide fiber bundle.

The third object of this invention is to provide an ignition cable having a low electrostatic capacity wherein cross-linked polyethylene or a polymer blend containing polyethylene is used as an insulating material in order to reduce dielectric constant considerably and improve high voltage-withstanding ability.

The fourth object of this invention is to facilitate peeling off of a semiconductive compound layer when the termination performed, by providing a stripping layer under the extruded semiconductive compound layer with the outer diameter of 1.2 mm or less.

Therefore in accordance with the present invention the high voltage ignition cable having low electrostatic capacity (or capacitance) is provided with a resistive-conductor core, an insulator layer, and a jacket, wherein the resistive-conductor core comprises a tension member prepared by intertwining a plurality of polyaramide fiber bundles around a central polyaramide fiber bundle.

BRIEF DESCRIPTION OF THE DRAWINGS

FIG. 1(*a*) shows a resistive-conductor core used in this invention, whereas FIG. 1(*b*) shows a resistive-conductor core used in a comparative known example.

DETAILED DESCRIPTION OF THE INVENTION

In order to suppress radio interference caused by ignition discharge, it is necessary to provide a resistance of about 16 KΩ/m in the core of the ignition cable. In general, therefore, a core having a diameter of about 1.8 mm, which is prepared by impregnating a glass fiber bundle with a 'carbon paint', has been employed. The carbon paint is a mixture of carbon black and a fluid binder which are dispersed in a solvent. When the diameter of the glass fiber bundle used as the tension member is reduced, the core may be cut during the course of extrusion or vulcanization of the insulator layer, jacket, or the like. This makes the commercial production of such an ignition cable difficult.

The defects encountered in the use of the glass fiber bundle can be overcome by using a polyaramide (e.g., "Kevler", a trademark for a product by E. I. Du Pont de Nemours Co.) fiber bundle of high strength. For example, by impregnating a 1,500 denier polyaramide fiber bundle with carbon paint, followed by drying, to provide a bundle having an outer diameter of 0.6 mm, extrusion-coating the bundle with a semiconductive material to prepare a core having an outer diameter of 1.0 mm and by providing on the core a cross-linked polyethylene insulator, a glass braid and an EP rubber (thylene-propylene rubber) or silicone rubber jacket in that order, an ignition cable having low electrostatic capacity of about 80 pF/m can be obtained.

It has been found, however, that the thus-obtained ignition cable of the low electrostatic capacity suffers from the disadvantage that it greatly varies in its resistance properties and it is not possible to produce stably on a commercial scale.

For example, by intertwining polyaramide fiber bundles of 200 denier around a polyaramide fiber bundle of 400 denier, coating thereon a silicone paint to form a stripping layer (such that the outer diameter of the resulting bundle is 0.7 mm), said silicone paint being prepared by a conductive substance, e.g., carbon, graphite, silver, or copper powder, being mixed with rubber or plastic, mixing the resulting mixture in a solvent to form a semiconductive paint, and by mixing the semiconductive paint with silicone compound, extrusion-coating a semiconductive material on the stripping layer to give a 1.1 mm diameter resistive-conductor core, and by providing on the resistive-conductor core a cross-linked polyethylene insulator layer, a glass braid, and an EP rubber or silicone rubber jacket, in that sequence, the ignition cable which is low in electrostatic capacity and uniform in conductor resistance can be obtained.

The ignition cable of this invention will hereinafter be explained by reference to the accompanying drawings.

Figure 1A:
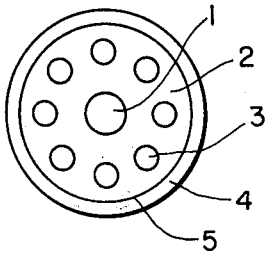
FIG. 1 shows diagrammatic sectional views of resistive-conductor cores of a high voltage-ignition cables.
Figure 1B:
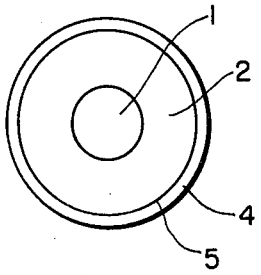

FIG. 1(*a*) shows a diagrammatic sectional view of a resistive conduct core used according to this invention, and FIG. 1(*b*) shows a sectional view of a comparative resistive-conductor core. In FIGS. 1(*a*) and 1(*b*), reference numeral 1 and numeral 3 indicate polyaramide fiber bundles, numeral 2 indicates a semiconductive paint layer, numeral 4 indicates a semiconductive material-extruded layer, and numeral 5 indicates a stripping layer provide between the semiconductive paint layer 2 and the semiconductive layer 4.

Figure 2:
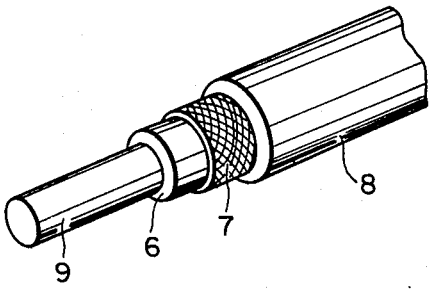
FIG. 2 is a perspective view of a high voltage-ignition cable using the resistor-conductor core of FIG. 1.

FIG. 2 shows a perspective view of general ignition cable in which the core of FIG. 1 is used. When the core of FIG. 1(*b*) is used in 1' the reference numeral 9 indicates the resistive-conductor core as shown in FIGS. 1(*a*) or 1(*b*) when the core illustrated in FIG. 1(*b*) is used as the core 9 of the cable, FIG. 2 denotes the cable of this invention. Numeral 6 indicates a cross-linked polyethylene insulator layer, numeral 7 indicates a reinforcing layer, e.g., a glass braid layer, and numeral 8 indicates an EP rubber or silicone rubber jacket.

Example dimensions of each element of such a cable are shown in Table 1.

The values of resistance and electrostatic capacity of the cables are shown in Table 2.

TABLE 1

| Construction | Example Thickness (mm) | Example Outer Diameter (mm) | Comparative Example Thickness (mm) | Comparative Example Outer Diameter (mm) |
|---|---|---|---|---|
| Core | | | | |
| Aromatic Polyamide Fiber Bundle | | | | |
| 400 denier × 1 | | 0.4 | | |
| 1,500 denier × 1 | | | | 0.5 |
| Semiconductive Paint Layer | 0.05 | 0.5 | | |
| Aromatic Polyamide Fiber Bundle Intertwined Layer | | | | |
| 200 denier × 8 | 0.05 | 0.6 | | |
| Semiconductive Paint Layer (plus stripping layer) | 0.05 | 0.7 | 0.10 | 0.7 |
| Semiconductive Compound Extruded Layer | 0.2 | 1.1 | 0.2 | 1.1 |
| Insulator | | | | |
| Cross-Linked Polyethylene Extruded Layer | 1.8 | 4.7 | 1.8 | 4.7 |
| Reinforcing Layer | | | | |
| Reinforcing Glass Braid | 0.1 | 4.9 | 0.1 | 4.9 |
| Jacket | | | | |
| EP Rubber or Silicone Rubber | 1.05 | 7.0 | 1.05 | 7.0 |

TABLE 2

| Test | Jacket Material: Example EP Rubber | Example Silicone Rubber | Comparative Example EP Rubber | Comparative Example Silicone Rubber |
|---|---|---|---|---|
| (Note 1) Electrostatic Capacity (pF/m) | 76 | 74 | 76 | 74 |
| (Note 2) Resistance (KΩ/m) (16Ω/m 20%) (") | o 14–18 | o 15–18 | x 13–20 | x 13–20 |
| Life Cycle (within the range of variation of resistance ±15%) (") | o | o | x | x |
| Dependency of Resistance on Temperature (within the range of heat variation of resistance ±20%) | o | o | o | o |
| (within the range of variation of resistance after returning to room temperature ±10%) (") | o | o | o | o |
| Dependency of Resistance on Moisture (within the range of variation of resistance ±15%) (") | o | o | o | o |
| Water Resistivity of Resistance (within the range of variation of resistance ±25%) | o | o | o | o |
| (Note 2) Oil Resistivity of Resistance (within the range of variation of resistance ±15%) (") | o | o | x | x |
| Life under Load (within the range of variation of resistance ±15%) (") | o | o | x | x |
| Impact Resistivity of Resistance (witin the range of variation of resistance ±5%) | o | o | x | x |

(Values in parentheses above indicate specification values.)

Notes:

(1) The electrostatic capacity test was performed according to JIS C-3004-1975, i.e., "Test of Rubber Insulated Cable". Particularly, a sample was immersed in water, grounded, and the electrostatic capacity between the sample and water was measured at 1,000 Hz by the AC bridge method, and it is expressed as a value per meter of the sample.

(2) The tests were performed according to JIS C-3409-1975, i.e. "High Voltage Resistive Cable for Prevention of Car Noise".

Symbol "o" denotes "satisfactory"

Symbol "x" denotes "unsatisfactory"

With regard to the electrostatic capacity, all the samples in Table showed values lower than 80 pF/m. although the values varied depending on the jacket material, and they exhibited sufficiently low values to be used as ignition cables of low electrostatic capacity.

In the comparative example, however, the variations in the various tests concerning the resistance value were large, and the samples of the comparative example would not be suitable as resistive cables.

On the other hand, in the samples of this invention, all of the test results were good, and the effects resulting from the use of the intertwinedpolyaramide fiber bundle around a central bundle are significant.

Although the exact reason why the ignition cable of this invention is stabilized and has a good resistance value is not completely clear, but it is believed that the reason is as follows:

In the ignition cable of this invention wherein the polyaramide fiber bundles are intertwined, when the insulator layer is stripped off at the end of the cable and the naked semiconductive core turned back on the jacket, the paint layer is not easily separated from the intertwined layer because the paint layer is held in meshes in meshes of the intertwined polyaramide fiber bundles, as compared with cables wherein the tension member is one polyaramide fiber bundle or merely twined polyaramide fiber bundles.

In this invention, the resistive-conductor core having only a semiconductive paint layer provided on a tensiv member (that is, without a stripping layer), or having thereon a semiconductive paint layer and a semiconductive compound layer extruded thereon, can be used, and the insulator layer may be a cross-linked product of a polyethylene-containing polymer blend (polyethylene and ethylene copolymer, or polyethylene and ethylene-$\alpha$-olefin copolymer, or the like). Furthermore, the reinforcing layer may be perforated tape, etc., as well as the braid, and may be provided between internal and external jacket as well as in the case of a single jacket, or the reinforcing layer may be omitted, if desired.

While the invention has been described in detail with reference to specific embodiments thereof, it will be apparent to one skilled in the art that various changes and modifications can be made therein without departing from the spirit and scope thereof.

What is claimed is:

1. A high voltage ignition cable having a low capacitance comprising a resistive-conductor core, an insulator layer, and a jacket, wherein the resistive-conductor core comprises a tension member prepared by intertwining a plurality of polyaramide fiber bundles around a central polyaramide fiber bundle, wherein said tension member is impregnated with a semiconductive paint.

2. A high voltage ignition cable having a low capacitance as in claim 1, wherein the insulator layer comprises cross-linked polyethylene.

3. A high voltage ignition cable having a low capacitance as in claim 1, wherein the resistive-conductor core comprises an extruded semiconductive compound layer over a stripping layer on the tension member impregnated with a semiconductive paint and dried, said core having an outer diameter of a maximum of 1.2 mm.

4. A high voltage ignition cable having a low capacitance as in claim 1, wherein the insulator layer comprises a cross-linked blend polymer containing polyethylene.

* * * * *